US008569964B2

(12) United States Patent
Xu et al.

(10) Patent No.: US 8,569,964 B2
(45) Date of Patent: Oct. 29, 2013

(54) CONTROL CIRCUIT OF LIGHT-EMITTING ELEMENT

(75) Inventors: Feng Xu, Gunma (JP); Yoshio Fujimura, Gunma (JP)

(73) Assignee: ON Semiconductor Trading, Ltd., Hamilton (BM)

( * ) Notice: Subject to any disclaimer, the term of this patent is extended or adjusted under 35 U.S.C. 154(b) by 256 days.

(21) Appl. No.: 13/096,652

(22) Filed: Apr. 28, 2011

(65) Prior Publication Data

US 2011/0266965 A1 Nov. 3, 2011

(30) Foreign Application Priority Data

Apr. 30, 2010 (JP) ..... 2010-104787

(51) Int. Cl.
*H05B 37/02* (2006.01)

(52) U.S. Cl.
USPC ..... 315/209 R; 315/311; 315/287

(58) Field of Classification Search
USPC ..... 315/209 R, 287, 291, 302, 307, 308, 315/311, 185 R, 186, 200 R, 201, 202
See application file for complete search history.

(56) References Cited

U.S. PATENT DOCUMENTS

| | | | | |
|---|---|---|---|---|
| 6,577,072 | B2 * | 6/2003 | Saito et al. | 315/185 R |
| 6,605,906 | B2 * | 8/2003 | Okamoto et al. | 315/291 |
| 8,324,832 | B2 * | 12/2012 | Yan et al. | 315/291 |
| 8,384,308 | B2 * | 2/2013 | Huang | 315/307 |

* cited by examiner

*Primary Examiner* — James H Cho
(74) *Attorney, Agent, or Firm* — Osha Liang LLP

(57) ABSTRACT

A control circuit of a light-emitting element comprises a rectifying unit (30) which full-wave rectifies an alternating current power supply, a switching element (38), a reference voltage generating unit (40) which generates a reference voltage (Vref), and a comparator (42) which receives a voltage (Srec) rectified by the rectifying unit (30), compares a comparative voltage (Vcmp) corresponding to a current flowing to an LED (102) and the reference voltage (Vref), and controls switching of the switching element (38) according to a comparison result, wherein the reference voltage generating unit (40) comprises a voltage dividing circuit having a transistor (Q1) in which a resistance value between a source and a drain is changed according to the voltage rectified by the rectifying unit (30), and outputs, using the voltage dividing circuit, the reference voltage (Vref) according to the voltage (Srec) rectified by the rectifying unit (30).

4 Claims, 5 Drawing Sheets

CONTROL CIRCUIT OF LIGHT-EMITTING ELEMENT

CROSS-REFERENCE TO RELATED APPLICATIONS

The entire disclosure of Japanese Patent Application No. 2010-104787 filed on Apr. 30, 2010, including specification, claims, drawings, and abstract, is incorporated herein by reference in its entirety.

BACKGROUND

1. Technical Field

The present invention relates to a control circuit which controls a light-emitting element.

2. Background Art

Currently, in order to dim the light-emission intensity (brightness) when an incandescent lamp is used as illumination, a system is used which controls the light-emission intensity by controlling a conduction angle of an alternating current (AC) power supply and reducing an average value of a current flowing in the incandescent lamp.

On the other hand, in view of energy conservation or the like, the use of a light-emitting diode (LED) as the light-emitting element for illumination in place of the incandescent lamp is desired. When the LED is used for illumination, it is desired to apply the dimmer system for incandescent lamp which is already used as the infrastructure.

FIG. 4 shows a control circuit 100 of an illumination system in the related art. The control circuit 100 comprises a rectifying unit 10, a rectifying capacitor 12, a choke coil 14, a regenerative diode 16, a switching element 18, a reference voltage generating unit 20, and a comparator 22.

When an AC power supply is supplied to the rectifying unit 10, the AC power supply is full-wave rectified. The full-wave rectified voltage is averaged by the rectifying capacitor 12, and is supplied to an anode terminal of the LED 102 as a drive voltage. A cathode of the LED 102 is grounded through a series connection of the choke coil 14, the switching element 18, and a resistor element R1. A terminal voltage of the resistor R1 is input to an inverted input terminal of the comparator 22 as a comparative voltage Vcmp. On the other hand, the reference voltage generating unit 20 comprises a series connection of a resistor R2, a Zener diode ZD, and a resistor R3, and divides the voltage rectified by the rectifying unit 10 and inputs a reference voltage Vref to a non-inverted input terminal of the comparator 22. Based on a comparison result between the reference voltage Vref and the comparative voltage Vcmp by the comparator 22, switching of the switching element 18 is controlled, a current is supplied to the LED 102 through the choke coil 14, the switching element 18, and the resistor element R1, and light is emitted from the LED 102. Here, when the comparative voltage Vcmp is lower than the reference voltage Vref, the switching element 18 is switched ON and the current is supplied to the LED 102, and when the comparative voltage Vcmp becomes larger than the reference voltage Vref, the switching element 18 is switched OFF and the current to the LED 102 is stopped. In this manner, the current flowing to the LED 102 is controlled, and the average light-emission intensity of the LED 102 can be controlled. In addition, the regenerative diode 16 which regenerates the energy stored in the choke coil 14 to the LED 102 when the switching element 18 is switched OFF is provided in parallel to the LED 102 and the choke coil 14.

In the control circuit 100 of the related art, as shown in FIG. 5, a full-wave rectified voltage Srec is generated with respect to an input voltage Vin from the dimmer, and the reference voltage Vref corresponding to the voltage Srec is generated by the reference voltage generating unit 20.

The voltage of the AC power supply for home use differs depending on the homes and the countries, and changes, for example, in a range of 100 V-200 V. In the control circuit 100 of the related art, when the voltage of the AC power supply is increased and a sum of the terminal voltages of the resistors R2 and R3 generated by the full-wave rectified voltage Srec becomes higher than a Zener voltage Vzd of the Zener diode ZD, the reference voltage Vref is clamped at the Zener voltage Vzd as shown in FIG. 6, and the control of the switching of the switching element 18 according to the waveform of the voltage Srec would not be executed. Because of this, there is a problem in that the power factor of the overall system is reduced and the efficiency is reduced.

SUMMARY

According to one aspect of the present invention, there is provided a control circuit of a light-emitting element, comprising a rectifying unit which full-wave rectifies an alternating current power supply, a switching element, a reference voltage generating unit which generates a reference voltage, and a comparator which receives a voltage rectified by the rectifying unit, compares a comparative voltage corresponding to a current flowing to the light-emitting element and the reference voltage, and controls switching of the switching element according to a comparison result, wherein the reference voltage generating unit comprises a voltage dividing circuit having a transistor in which a resistance value between a source and a drain is changed according to the voltage rectified by the rectifying unit, and outputs, using the voltage dividing circuit, the reference voltage according to the voltage rectified by the rectifying unit.

According to another aspect of the present invention, there is provided a control circuit of a light-emitting element, comprising a rectifying unit which full-wave rectifies an alternating current power supply, a switching element, a reference voltage generating unit which generates a reference voltage, and a comparator which receives a voltage rectified by the rectifying unit, compares a comparative voltage corresponding to a current flowing to the light-emitting element and the reference voltage, and controls switching of the switching element according to a comparison result, wherein the reference voltage generating unit comprises a comparator which changes the reference voltage according to the voltage rectified by the rectifying unit.

BRIEF DESCRIPTION OF THE DRAWINGS

Preferred embodiments of the present invention will be described in further detail based on the following drawings, wherein.

DESCRIPTION OF EMBODIMENT

First Preferred Embodiment

Figure 1:
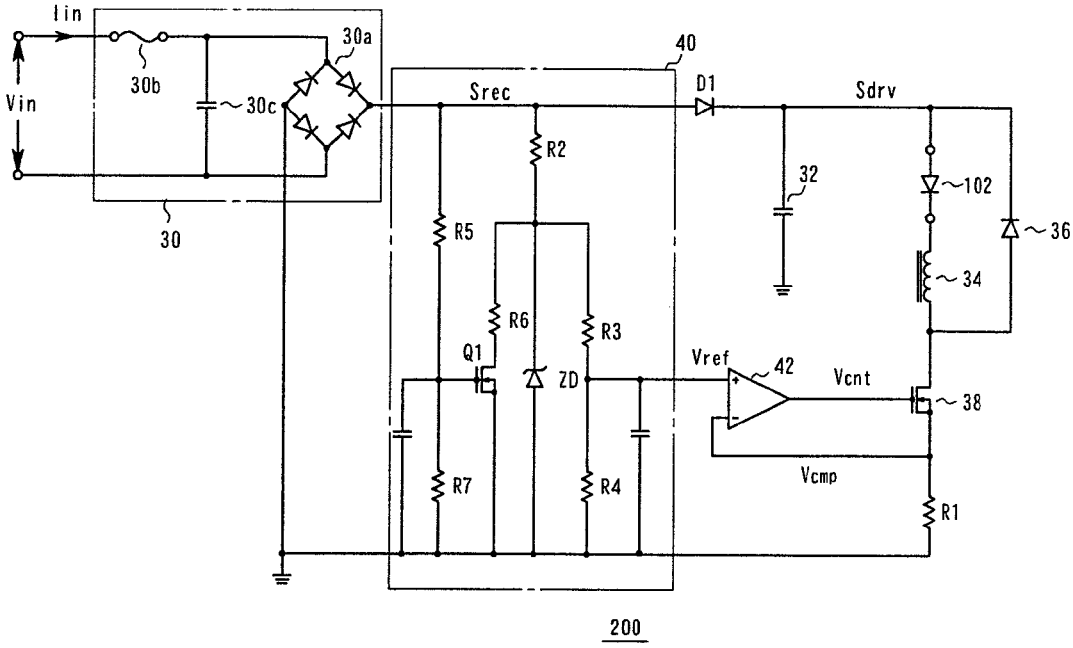
FIG. 1 is a diagram showing a structure of a control circuit of a light-emitting element according to a first preferred embodiment of the present invention.
Figure 2:
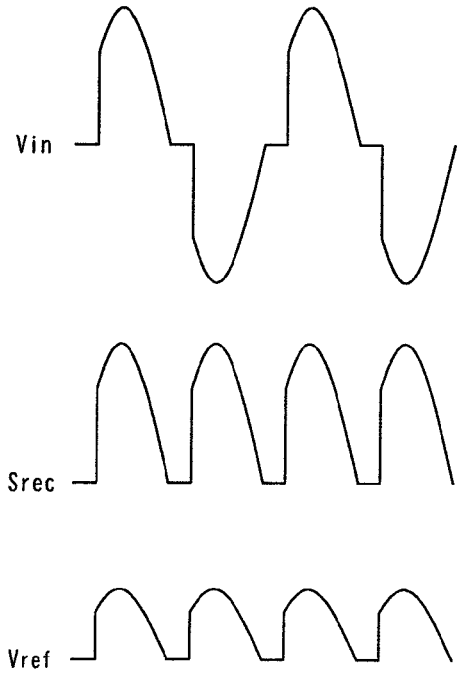
FIG. 2 is a diagram showing an operation of a control circuit of a light-emitting element according to a preferred embodiment of the present invention.

As shown in FIG. 1, a control circuit 200 of a light-emitting element according to a first preferred embodiment of the present invention comprises a rectifying unit 30, an averaging capacitor 32, a choke coil 34, a regenerative diode 36, a switching element 38, a reference voltage generating unit 40, and a comparator 42. FIG. 2 is a diagram showing an example of a change with respect to time of signals of the sections of the control circuit 200.

The control circuit 200 controls light emission of the light-emitting element. For example, the control circuit 200 is connected to a light-emitting diode (LED) 102 for illumination, and controls a current to the LED 102. In addition, the control circuit 200 is used connected to the dimmer circuit which controls the conduction angle of the AC power supply used in a dimmer system of an incandescent lamp. The dimmer circuit is connected to the rectifying unit 30 of the control circuit 200. That is, the dimmer circuit receives an AC power supply, adjusts the conduction angle of the AC power supply according to an adjustment signal such as the dimmer volume, and inputs an adjusted AC voltage Vin to the control circuit 200.

The rectifying unit 30 comprises a rectifying bridge circuit 30*a*. The rectifying unit 30 receives the adjusted AC voltage Vin, full-wave rectifies the adjusted AC voltage Vin, and outputs as a full-wave rectified voltage Srec. As shown in FIG. 1, a fuse 30*b* for protection and a filter 30*c* for noise removal may be provided in the rectifying unit 30.

On the downstream side of the rectifying unit 30, an anode terminal of the LED 102 is connected through a diode D1. The averaging capacitor 32 is also connected to the anode terminal of the LED 102. A cathode terminal of the LED 102 is grounded through the choke coil 34, the switching element 38, and a voltage detecting resistor R1. A voltage Sdry which is obtained by averaging the full-wave rectified voltage Srec by the averaging capacitor 32 is applied to the LED 102.

The choke coil 34 is provided in order to make the current flowing through the LED 102 and the switching element 38 intermittent. Alternatively, a forward winding may be provided in the choke coil 34 in order to enable supply of a power supply voltage to a controller 40.

The regenerative diode 36 is a flywheel diode, and is connected in parallel with the LED 102 and the choke coil 34. The regenerative diode 36 regenerates the energy stored in the choke coil 34 to the LED 102 when the switching element 38 is disconnected.

The switching element 38 is provided for supplying or stopping the current to the LED 102. The switching element 38 is an element having a capacity corresponding to a power consumption of the LED 102, and, for example, a large-power field effect transistor (MOSFET) or the like is used. The switching of the switching element 38 is controlled by a control signal Vcnt of the comparator 42.

The reference voltage generating unit 40 comprises resistors R2-R7, a Zener diode ZD, and a transistor Q1. The reference voltage generating unit 40 receives the full-wave rectified voltage Srec rectified by the rectifying unit 30 to generate a reference voltage Vref, and inputs the reference voltage Vref to a non-inverting input terminal of the comparator 22.

The reference voltage generating unit 40 comprises a voltage dividing circuit in which a series connection of resistors R3 and R4 is connected in parallel with a series connection of a resistor R6 and a resistor $R_{Q1}$ between a source and a drain of the transistor Q1, and a resistor R2 is connected in series to the parallel connection. With this structure, the reference voltage Vref is represented by the following equation (1).

Equation 1

$$V_{ref} = \frac{(R3 + R4)(R6 + R_{Q1})}{R2(R3 + R4 + R6 + R_{Q1}) + (R3 + R4)(R6 + R_{Q1})} \cdot \frac{R4}{R3 + R4} \quad (1)$$

In addition, the full-wave rectified voltage Srec is divided by the resistors R5 and R7, and a terminal voltage of the resistor R7 is input to a gate of the transistor Q1. With this configuration, the resistance $R_{Q1}$ between the source and the drain of the transistor Q1 changes according to the change of the full-wave rectified voltage Srec. In other words, as the full-wave rectified voltage Srec is increased, the resistance $R_{Q1}$ between the source and the drain of the transistor Q1 is reduced, and as the full-wave rectified voltage Srec is reduced, the resistance $R_{Q1}$ between the source and the drain of the transistor Q1 is increased. Therefore, as the full-wave rectified voltage Srec becomes larger, the current drawn into the resistor R6 and the transistor Q1 becomes larger, a ratio of an increase of the reference voltage Vref which is the terminal voltage of the resistor R4 with respect to an increase in the full-wave rectified voltage Srec is reduced, and the increase in the reference voltage Vref is inhibited. In this manner, the ratio of the increase of the reference voltage Vref with respect to the increase in the voltage is changed as the voltage rectified by the rectifying unit 30 is increased. Therefore, a peak value of the full-wave rectified voltage Srec can be further increased until the reference voltage Vref is clamped by the Zener diode ZD.

FIG. 2 is a diagram showing an example change with respect to time of the reference voltage Vref when the peak value of the full-wave rectified voltage Srec is increased. As shown in FIG. 2, even when the peak value of the full-wave rectified voltage Srec is increased, the reference voltage Vref can follow the change with respect to time of the full-wave rectified voltage Srec without the reference voltage Vref being clamped by the Zener diode ZD.

The comparator 42 receives, at an inverted terminal, a comparative voltage Vcmp generated between both terminals of the voltage detecting resistor R1 by the current flowing through the LED 102 at an inverted input terminal. In addition, the comparator 42 receives the reference voltage Vref obtained by the reference voltage generating unit 40 at anon-inverting input terminal. The comparator 42 compares the comparative voltage Vcmp and the reference voltage Vref, and outputs the control signal Vcnt corresponding to a difference between the comparative voltage Vcmp and the reference voltage Vref. The comparator 42 outputs the control signal Vcnt such that the current flowing through the switching element 38 becomes smaller as the comparative voltage Vcmp becomes lower compared to the reference voltage Vref. In addition, the comparator 42 outputs the control signal Vcnt such that the current flowing through the switching element 38 becomes larger as the comparative voltage Vcmp becomes larger compared to the reference voltage Vref.

The switching element 38 is switched ON until the comparative voltage Vcmp is increased to the reference voltage Vref according to the control signal Vcnt from the comparator 42, and when the comparative voltage Vcmp exceeds the reference voltage Vref, the switching element 38 is switched OFF, and these states are repeated. In this manner, it is possible to supply a current I corresponding to the full-wave rectified voltage Srec without exceeding the rated current of the LED 102. Therefore, light can be emitted from the LED 102 at an intensity corresponding to the drive voltage Sdry reflecting the average value of the input voltage Vin obtained by adjusting the conduction angle of the AC power supply.

<Alternative Configuration>

In the above-described preferred embodiment of the present invention, the control circuit 200 of a non-insulated type is employed. Alternatively, control circuits 400, 402, and 404 of an insulated type, as shown in FIGS. 7-9, may be employed.

Figure 7:
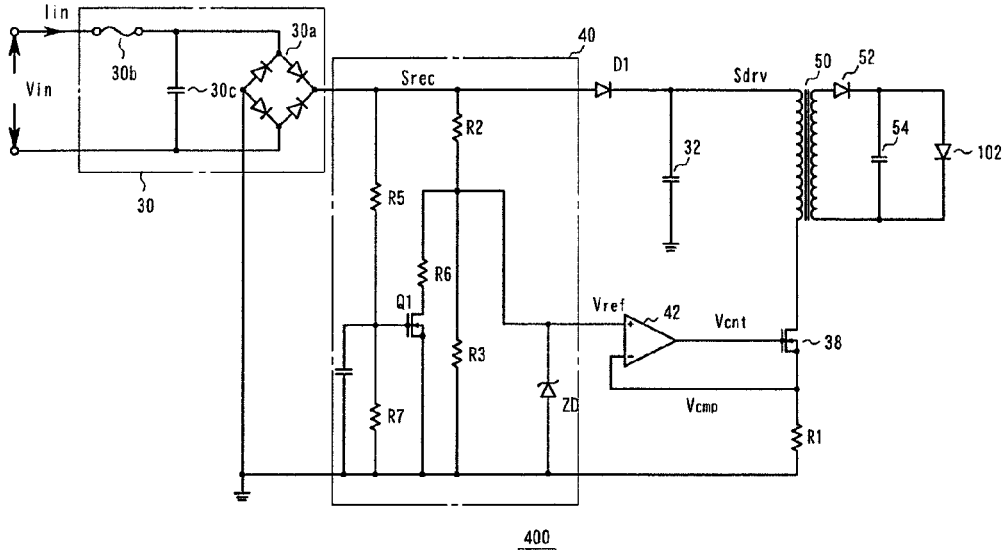
FIG. 7 is a diagram showing a structure of another example control circuit of the light-emitting element according to the first preferred embodiment of the present invention.
Figure 8:
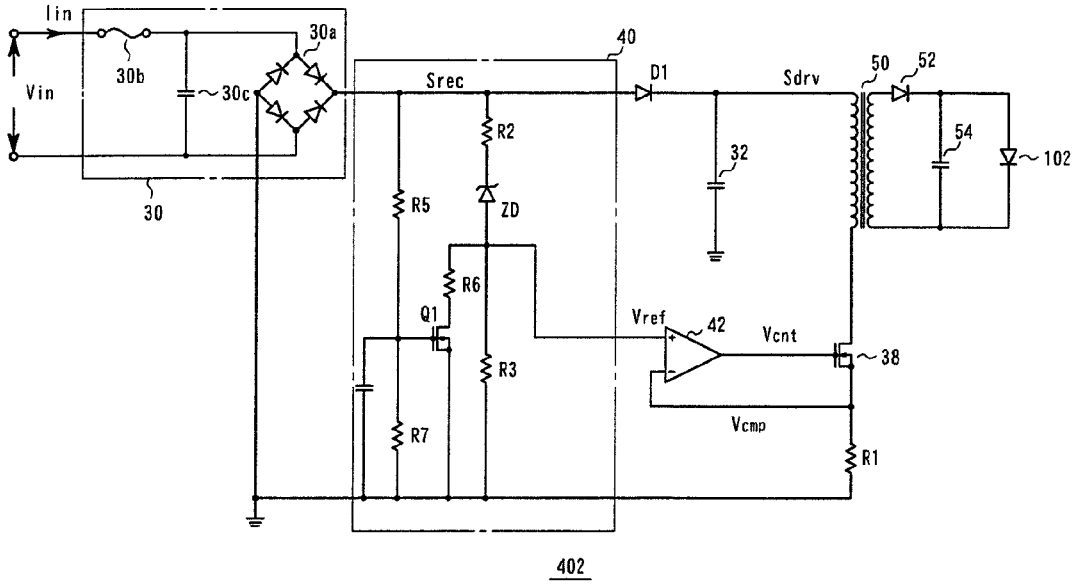
FIG. 8 is a diagram showing a structure of another example control circuit of the light-emitting element according to the first preferred embodiment of the present invention.
Figure 9:
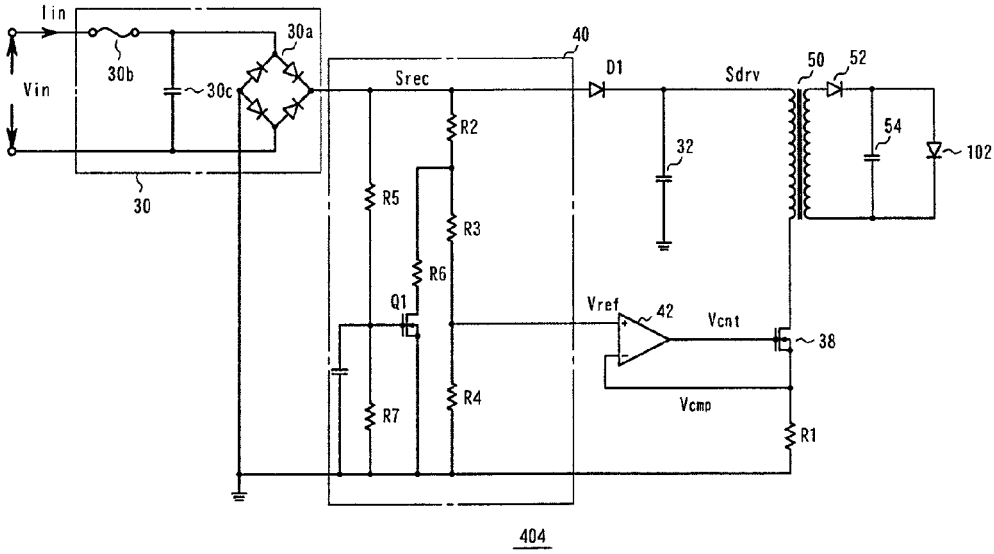
FIG. 9 is a diagram showing a structure of another example control circuit of the light-emitting element according to the first preferred embodiment of the present invention.

In the control circuits 400, 402, and 404 of insulated type shown in FIGS. 7-9, the rectifying unit 30 is connected to one terminal of a primary side winding of a transformer 50 through a diode D1, and the other terminal of the primary side winding of the transformer 50 is grounded though the switching element 38 and the voltage detecting resistor R1. One terminal of a secondary side winding of the transformer 50 is connected to the anode terminal of the LED 102 through a rectifying diode 52, and the other terminal of the secondary side winding of the transformer 50 is connected to the cathode terminal of the LED 102. In addition, in order to stabilize the voltage between terminals of the LED 102, an averaging capacitor 54 is connected between the anode terminal and the cathode terminal of the LED 102, in parallel to the LED 102.

In the configuration shown in FIG. 7, the full-rectified voltage Srec is divided by the resistors R5 and R7, and the terminal voltage of the resistor R7 is input to the gate of the transistor Q1. With this configuration, the resistance $R_{Q1}$ between the source and the drain of the transistor Q1 changes according to the change of the full-wave rectified voltage Srec. In other words, as the full-wave rectified voltage Srec is increased, the resistance $R_{Q1}$ between the source and the drain of the transistor Q1 is reduced, and as the full-wave rectified voltage Srec is reduced, the resistance $R_{Q1}$ between the source and the drain of the transistor Q1 is increased. Therefore, as the full-wave rectified voltage Srec becomes larger, the current drawn into the resistor R6 and the transistor Q1 becomes larger, a ratio of an increase of the reference voltage Vref which is the terminal voltage of the resistor R3 with respect to an increase in the full-wave rectified voltage Srec is reduced, and the increase in the reference voltage Vref is inhibited. In this manner, the ratio of the increase of the reference voltage Vref with respect to the increase in the voltage is changed as the voltage rectified by the rectifying unit 30 is increased. Therefore, the peak value of the full-wave rectified voltage Srec can be further increased until the reference voltage Vref is clamped by the Zener diode ZD.

The comparator 42 receives, at an inverting input terminal, a comparative voltage Vcmp generated between both terminals of the voltage detecting resistor R1 by the current flowing through the primary side winding of the transformer 50 (having a current value corresponding to the current flowing through the LED 102). In addition, the comparator 42 receives the reference voltage Vref obtained by the reference voltage generating unit 40 at a non-inverting input terminal, and outputs the control signal Vcnt corresponding to a difference between the comparative voltage Vcmp and the reference voltage Vref. The comparator 42 outputs the control signal Vcnt such that the current flowing through the switching element 38 becomes smaller as the comparative voltage Vcmp becomes lower compared to the reference voltage Vref. In addition, the comparator 42 outputs the control signal Vcnt such that the current flowing through the switching element 38 becomes larger as the comparative voltage Vcmp becomes larger compared to the reference voltage Vref.

The switching element 38 is switched ON until the comparative voltage Vcmp is increased to the reference voltage Vref according to the control signal Vcnt from the comparator 42, and when the comparative voltage Vcmp exceeds the reference voltage Vref, the switching element 38 is switched OFF, and these states are repeated. In this manner, it is possible to supply a current I corresponding to the full-wave rectified voltage Srec without exceeding the rated current of the LED 102 connected to the secondary side winding of the transformer 50. Therefore, light can be emitted from the LED 102 at an intensity corresponding to the drive voltage Sdry reflecting the average value of the input voltage Vin obtained by adjusting the conduction angle of the AC power supply.

In the configuration shown in FIG. 8, as the full-wave rectified voltage Srec becomes larger, the current drawn into the resistor R6 and the transistor Q1 becomes larger, a ratio of an increase of the reference voltage Vref which is the terminal voltage of the resistor R3 with respect to an increase in the full-wave rectified voltage Srec is reduced, and the increase in the reference voltage Vref is inhibited. In this manner, the ratio of the increase of the reference voltage Vref with respect to the increase in the voltage is changed as the voltage rectified by the rectifying unit 30 is increased. Therefore, the peak value of the full-wave rectified voltage Srec can be further increased until the reference voltage Vref is clamped by a series circuit of the resistor R2, the Zener diode ZD, and the resistor R3. The operation of the comparator 42 is similar to that in the control circuit 400.

In the configuration shown in FIG. 9, as the full-wave rectified voltage Srec becomes larger, the current drawn into the resistor R6 and the transistor Q1 becomes larger, a ratio of an increase of the reference voltage Vref which is the terminal voltage of the resistor R3 with respect to an increase in the full-wave rectified voltage Srec is reduced, and the increase in the reference voltage Vref is inhibited. In this manner, the ratio of the increase of the reference voltage Vref with respect to the increase in the voltage is changed as the voltage rectified by the rectifying unit 30 is increased. Therefore, the reference voltage Vref is determined by a voltage division ratio of the series circuit of the resistors R2, R3, and R4, and the peak value of the full-wave rectified voltage Srec can be further increased. The operation of the comparator 42 is similar to that in the control circuit 400.

Second Preferred Embodiment

Figure 3:
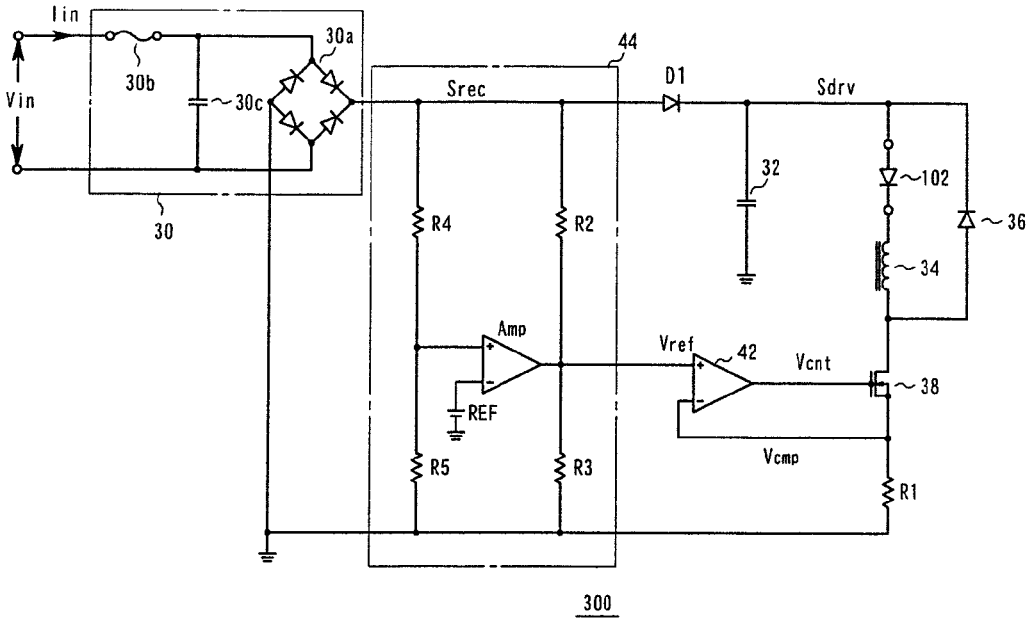
FIG. 3 is a diagram showing a structure of a control circuit of a light-emitting element according to a second preferred embodiment of the present invention.
Figure 4:
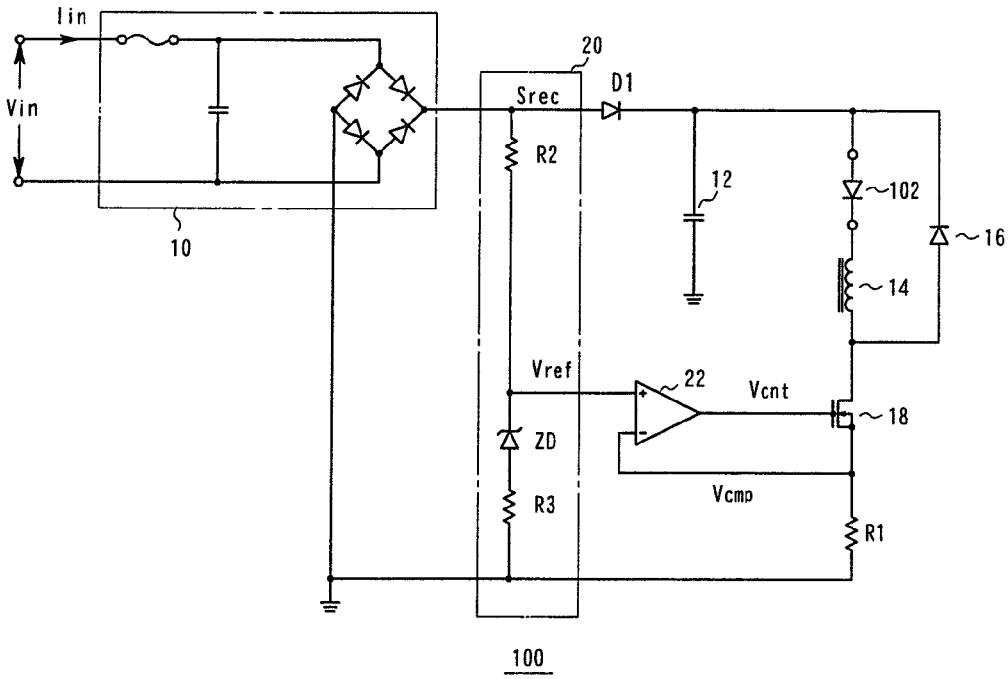
FIG. 4 RELATED ART
FIG. 4 is a diagram showing a structure of a control circuit of light emission of an LED in related art.
Figure 5:
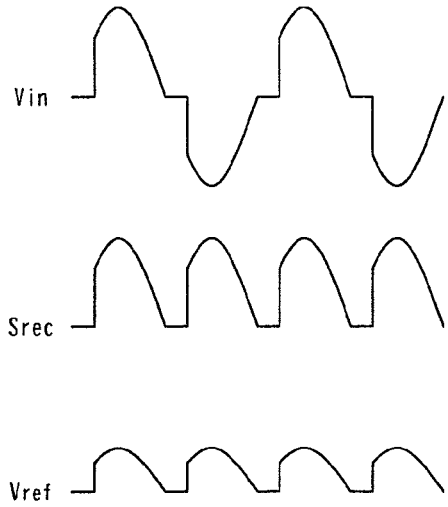
FIG. 5 RELATED ART
FIG. 5 is a diagram showing an operation of the control circuit of the light-emitting element in the related art.
Figure 6:
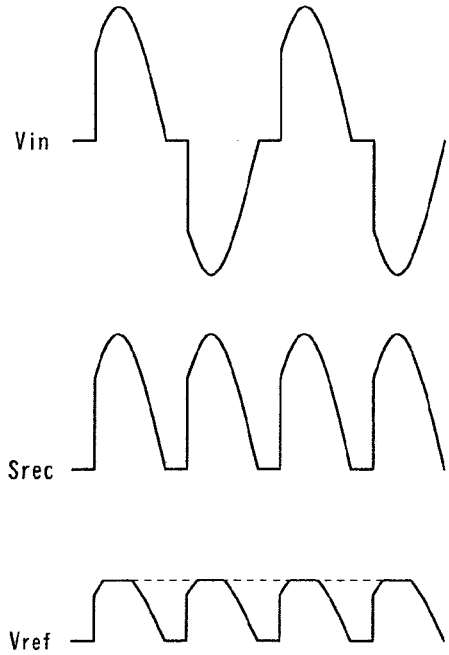
FIG. 6 RELATED ART
FIG. 6 is a diagram showing an operation of the control circuit of the light-emitting element in the related art.

As shown in FIG. 3, a control circuit 300 of a light-emitting element in a second preferred embodiment of the present invention comprises the rectifying unit 30, the averaging capacitor 32, the choke coil 34, the regenerative diode 36, the switching element 38, a reference voltage generating unit 44, and the comparator 42.

The control circuit 300 is a circuit in which the reference voltage generating unit 44 is provided in place of the reference voltage generating unit 40 of the control circuit 200 in the first preferred embodiment of the present invention. Therefore, the structures of the control circuit 300 other than the reference voltage generating unit 44 will not be described again.

The reference voltage generating unit 44 comprises resistors R2-R5 and a comparator Amp. The full-wave rectified voltage Srec is divided by the resistors R4 and R5, and a terminal voltage of the resistor R5 is input to a non-inverted input terminal of the comparator Amp. A direct current voltage REF is applied to an inverting input terminal of the comparator Amp. The comparator Amp outputs a reference voltage Vref corresponding to a difference between the terminal voltage of the resistor R5 and the direct current voltage REF. More specifically, the reference voltage Vref which is output by the comparator Amp is increased as the full-wave rectified voltage Srec becomes larger, and the reference voltage Vref which is output by the comparator Amp becomes lower as the full-wave rectified voltage Srec becomes lower.

Therefore, similar to the structure of FIG. 2, even if the peak value of the full-wave rectified voltage Srec becomes large, the reference voltage Vref can follow the change with respect to time of the full-wave rectified voltage Srec without the reference voltage Vref being clamped.

<Alternative Configuration>

In the above-described preferred embodiment of the present invention, the control circuit 300 of a non-insulated type is employed. Alternatively, a control circuit 302 of an insulated type as shown in FIG. 10 may be employed.

Figure 10:
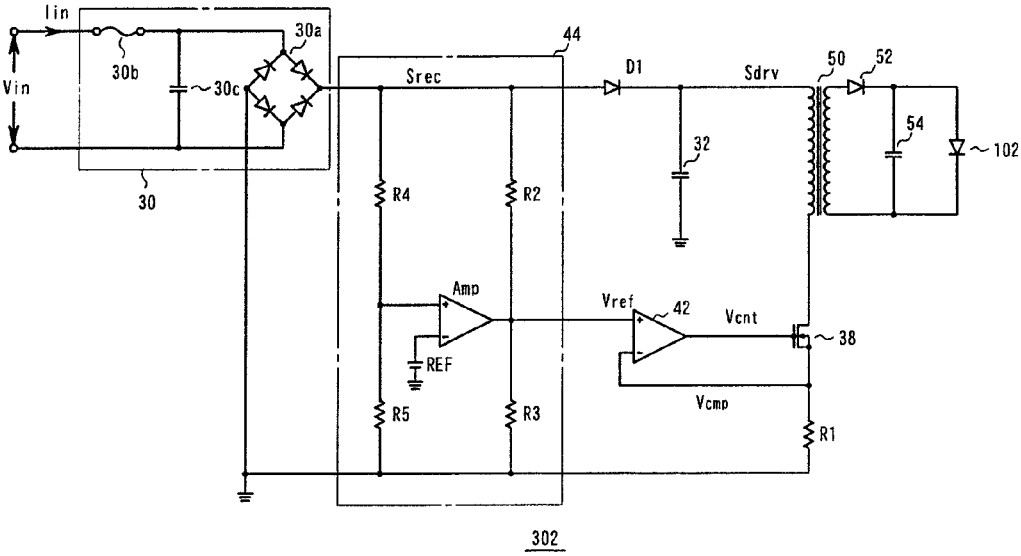
FIG. 10 is a diagram showing a structure of another example control circuit of the light-emitting element according to the second preferred embodiment of the present invention.

In the control circuit 302 of insulated type shown in FIG. 10, similar to the control circuits 400, 402, and 404 of insulated type shown in FIGS. 7-9, the rectifying unit 30 is connected to one terminal of the primary side winding of the transformer 50 through the diode D1, and the other terminal of the primary side winding of the transformer 50 is grounded though the switching element 38 and the voltage detecting resistor R1. One terminal of the secondary side winding of the transformer 50 is connected to the anode terminal of the LED 102 through the rectifying diode 52, and the other terminal of the secondary side winding of the transformer 50 is connected to the cathode terminal of the LED 102. In addition, in order to stabilize the voltage between terminals of the LED 102, the averaging capacitor 54 is connected between the anode terminal and the cathode terminal of the LED 102, in parallel to the LED 102.

In the control circuit 302, the operation of the reference voltage generating unit 44 is similar to that in the control circuit 300. Namely, the reference voltage Vref which is output by the comparator Amp is increased as the full-wave rectified voltage Srec becomes larger, and the reference voltage Vref which is output by the comparator Amp becomes lower as the full-wave rectified voltage Srec becomes lower. Therefore, similar to the structure of FIG. 2, even if the peak value of the full-wave rectified voltage Srec becomes large, the reference voltage Vref can follow the change with respect to time of the full-wave rectified voltage Srec without the reference voltage Vref being clamped.

What is claimed is:

1. A control circuit of a light-emitting element, comprising:

a rectifying unit which full-wave rectifies an alternating current power supply;

a switching element;

a reference voltage generating unit which generates a reference voltage; and a comparator which receives a voltage rectified by the rectifying unit, compares a comparative voltage corresponding to a current flowing to the light-emitting element and the reference voltage, and controls switching of the switching element according to a comparison result, wherein the reference voltage generating unit comprises a voltage dividing circuit having a transistor in which a resistance value between a source and a drain is changed according to the voltage rectified by the rectifying unit, and outputs, using the voltage dividing circuit, the reference voltage according to the voltage rectified by the rectifying unit.

2. The control circuit of the light-emitting element according to claim 1, wherein the reference voltage generating unit changes, as the voltage rectified by the rectifying unit becomes higher, a ratio of an increase of the reference voltage corresponding to an increase in the voltage rectified by the rectifying unit.

3. A control circuit of a light-emitting element, comprising:

a rectifying unit which full-wave rectifies an alternating current power supply;

a switching element;

a reference voltage generating unit which generates a reference voltage; and a comparator which receives a voltage rectified by the rectifying unit, compares a comparative voltage corresponding to a current flowing to a primary side winding of a transformer having a secondary side winding connected to the light-emitting element and the reference voltage, and controls switching of the switching element according to a comparison result, wherein the reference voltage generating unit comprises a voltage dividing circuit having a transistor in which a resistance value between a source and a drain is changed according to the voltage rectified by the rectifying unit, and outputs, using the voltage dividing circuit, the reference voltage according to the voltage rectified by the rectifying unit.

4. The control circuit of the light-emitting element according to claim 3, wherein the reference voltage generating unit changes, as the voltage rectified by the rectifying unit becomes higher, a ratio of an increase of the reference voltage corresponding to an increase in the voltage rectified by the rectifying unit.

* * * * *